United States Patent [19]

McDonald

[11] 4,385,738

[45] May 31, 1983

[54] PORTABLE SPOOL HOLDER

[76] Inventor: Colin McDonald, 20241 SE. 232 St., Maple Valley, Wash. 98038

[21] Appl. No.: 281,086

[22] Filed: Jul. 7, 1981

[51] Int. Cl.[3] ..... B65H 49/00

[52] U.S. Cl. ..... 242/129.6; 242/137

[58] Field of Search ..... 242/55.3, 129.5, 129.6, 242/129.62, 134–137.1, 138, 86.5 R, 90; 225/34, 46, 47; 211/59

[56] References Cited

U.S. PATENT DOCUMENTS

| | | | |
|---|---|---|---|
| 96,032 | 10/1869 | Patton | 242/129.6 |
| 195,983 | 10/1877 | Chase . | |
| 467,549 | 1/1892 | Saunders | 242/129.62 |
| 559,364 | 5/1896 | Christensen . | |
| 780,479 | 1/1905 | Case | 242/137 |
| 1,022,077 | 4/1912 | Haas | 242/129.62 |
| 1,149,263 | 8/1915 | Hradecky . | |
| 1,566,950 | 12/1925 | Yushka | 242/129.62 |
| 1,848,744 | 3/1932 | Pavlas . | |
| 2,148,860 | 2/1939 | Huber | 242/137 |
| 3,672,550 | 6/1972 | Greco | 225/34 |
| 3,897,914 | 8/1975 | McCarthy et al. | 242/129.6 |

*Primary Examiner*—Leonard D. Christian

[57] ABSTRACT

A horizontal rectangular upper loop 10 is supported by four support members 20 attached to a base 4. Two shafts 30, offset from the loop 10, are supported at their ends by the support members 20 and at their midpoints by a U-shaped shaft support 40. The shaft support 40 is upwardly opening and has two ends 42 attached to opposite end members 14 of the loop 10. Two spools are mounted on each shaft 30, one on either side of the shaft support 40. Any one spool can be replaced without disturbing any other spool.

7 Claims, 3 Drawing Figures

PORTABLE SPOOL HOLDER

TECHNICAL FIELD

The present invention relates to apparatus for transporting and dispensing wier or the like from spools, and more particularly to a lightweight multiple-spool holder that includes a structural member which separates adjacently mounted spools.

RELATED APPLICATIONS

This application is related to applicant's copending application Ser. No. 251,257, filed Apr. 6, 1981, and entitled Weight Balanced Spool Carrier.

BACKGROUND ART

Spool holders are disclosed by U.S. Pat. No. 96,032, granted Oct. 19, 1869, to W. P. Patton; U.S. Pat. No. 195,883, granted Oct. 9, 1877, to J. P. Buzzel; U.S. Pat. No. 559,364, granted May 5, 1896, to Christ Christensen; U.S. Pat. No. 1,022,077, granted Apr. 2, 1912, to S. Haas; U.S. Pat. No. 1,149,263, granted Aug. 10, 1915, to C. F. Hradecky; U.S. Pat. No. 1,566,950, granted Dec. 22, 1925, to T. Yushka; U.S. Pat. No. 1,848,744, granted Mar. 8, 1932, to J. Pavlas; and U.S. Pat. No. 3,897,914, granted Aug. 5, 1975, to McCarthy et al.

The spool holders disclosed by U.S. Pat. Nos., Patton 96,032; Buzzel 195,883; Yushka 1,566,950; and Pavlas 1,848,744 include structural members that divide adjacently mounted spools. The Pavlas patent discloses a portable, vertically oriented holder with a plate that separates the spools and provides support for the shaft during loading.

Portable, heavy duty spool holders are disclosed by U.S. Pat. No. 422,262, granted Feb. 25, 1890, to J. H. Stringer; U.S. Pat. No. 1,214,772, granted Feb. 6, 1917, to J. A. Fouts; U.S. Pat. No. 2,705,114, granted Mar. 29, 1955 to E. L. Worsham; U.S. Pat. No. 3,134,555, granted May 26, 1964, to G. W. Baker; U.S. Pat. No. 3,831,877, granted Aug. 27, 1974, to Bennett et al; and U.S. Pat. No. 3,856,230, granted Dec. 24, 1974, to Zimmer. All of these patents disclose spool holders with wheels, except that Stringer U.S. Pat. No. 422,262 discloses a holder with a sled-type construction.

Various forms of wheeled wire carriers are currently being marketed. Cobra Wire Leader Corporation of 4742 South Tennessee Place, Tuscon, Ariz. 85714, markets a carrier under the name WIRE CADDY. Greenlee Tool Co. of 2136 12th Street, Rockford, Ill. 61101, a unit of Ex-Cell-O Corp., sells three models: No. 908 Dispenser, No. 909 Dispenser, and No. 910 Wire Dispenser.

The above described patents, together with the prior art that was cited and considered by the Patent Office before granting them, as listed on such patents, should be carefully considered for the purpose of properly evaluating the subject invention and putting it into proper perspective relative to the prior art.

DISCLOSURE OF THE INVENTION

The subject of this invention is a portable spool holder. In its basic form, according to an aspect of the invention, the holder includes a base and an essentially rectangular upper loop. The loop is positioned above and essentially parallel to the base and has two opposite side members and two opposite end members which are essentially perpendicular to the side members. At least two support members connect the base to the loop, with one such support member connecting the base to an intermediate portion of each side member of the loop. A cylindrical shaft has two ends which are each removably attached to one of the support members. The shaft is offset from and essentially parallel to the end members of the loop. An upwardly opening, U-shaped shaft support has each of its two ends attached to an intermediate portion of one of the end members of the loop. This shaft support is essentially perpendicular to the shaft and has an upper portion which is contiguous to the shaft.

According to another aspect of the invention, two support members connect the base to each side membr of the loop, and two spaced, parallel shafts are removably attached to the support members.

According to another aspect of the invention, the base is the same size and peripheral shape as the upper loop, and corresponding portions of the base and the upper loop are connected by each support member.

According to yet another aspect of the invention, the upper loop, base, and shaft support are made of solid rods, and the shafts are made of rigid hollow tubing. Each support member comprises a flat rectangular bar which has a smallest dimension that is parallel to the end members of the upper loop.

The primary object of this invention is to provide a multiple-spool holder that a single person can easily carry and load by hand.

Another object of this invention is to provide a multiple-spool holder from which wire or the like can be drawn from less than all of the spools mounted thereon without causing coasting or over-reeling of the spools not then in use.

Other objects of the invention are: to provide a multiple-spool holder that holds spools of various sizes; to provide a multiple-spool holder from which wire or the like can be drawn in either a horizontal or a vertical direction without tangling; to provide a multiple-spool holder in which the spools are always visible so that the amount of wire or the like on each spool can be readily ascertained; to provide a multiple-spool holder of simple construction that can be easily and inexpensively manufactured; and to provide an improvement over the use of separate cardboard boxes, each containing a single spool.

These and other objects, advantages, and features will become apparent from the detailed description of the preferred embodiment that follows.

BRIEF DESCRIPTION OF THE DRAWINGS

In the drawings, like element designations refer to like parts throughout, and.

DESCRIPTION OF THE PREFERRED EMBODIMENT

Figure 1:
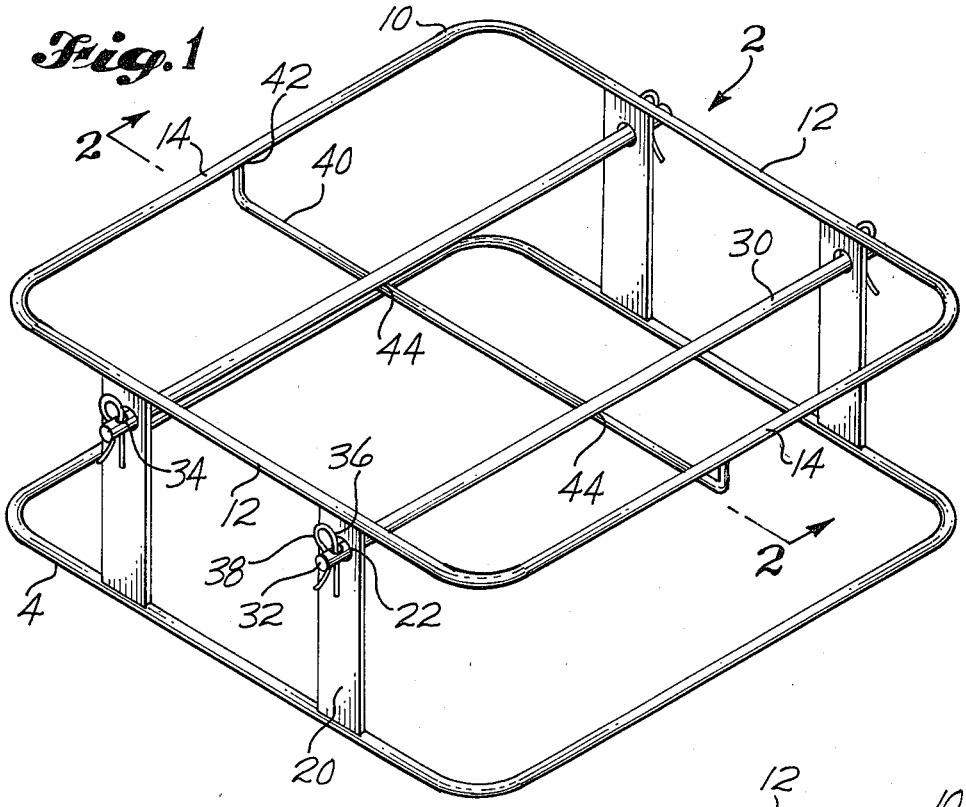
FIG. 1 is a pictorial view of the preferred embodiment of the invention.

The drawings show a spool holder 2 that is constructed according to the invention and that also constitutes the best mode of the invention currently known to the applicant. The spool holder 2 comprises a base 4 and an essentially rectangular upper loop 10 positioned above and essentially parallel to the base 4. The upper loop 10 has two opposite side members 12 and two opposite end members 14 which are essentially perpendicular to the side members 12. Two support members 20 connect the base 4 to intermediate portions of each side member 12 of the loop 10. Therefore, there are a total of four support members 20. Two spaced, parallel shafts 30 are removably attached to the support members 20. Each shaft 30 is cylindrical and has two ends, each of which is removably attached to one of the support members 20. Each shaft 30 is offset from and essentially parallel to the end members 14 of the loop 10. The two shafts 30 are spaced so that each one can be loaded with spools without interfering with the spools on the other shaft 30.

The spool holder 2 also includes an upwardly opening, U-shaped shaft support 40, the two ends 42 of which are each attached to an intermediate portion, preferably the midpoint, of each of the end members 14 of the loop 10. This shaft support 40 is essentially perpendicular to the shafts 30 and has uppoer portions 44 which are contiguous to the shafts 30. In other words, each shaft 30 rests on one of the upper portions 44 of the shaft support 40, and the shaft support 40 thereby furnishes support for the shafts 30.

The base 4 is the same size and peripheral shape as the upper loop 10, and corresponding portions of the base 4 and the upper loop 10 are connected by each support member 20. Preferably, the shafts 30 are made of rigid hollow tubing, and the upper loop 10, base 4, and shaft support 40 are made of solid rods. Thus, in the preferred embodiment the upper loop 10 and the base 4 are identical in shape and size. In addition, each support member 20 comprises a flat rectangular bar with a smallest dimension parallel to the end members 14 of the upper loop 10. This construction results in a spool holder 2 that is very lightweight and that is easy and inexpensive to manufacture. Each of the elements may be fashioned from a variety of materials, such as aluminum or a strong plastic.

The U-shaped shaft support 40 performs three important functions. First, it is a structural member that reinforces the upper loop 10 and carries part of the weight of the spools. Second, it separates two spools that are adjacently mounted on the same shaft 30. Therefore, it prevents the end of a rotating spool from frictionally driving the adjacent spool. This function is particularly important when wire or the like is being removed from only one spool on the shaft 30.

The third function of the shaft support 40 makes it easy for a single person to load the spool holder 2 or to remove and replace any one spool without disturbing the other spools already loaded on the spool holder 2. The loading process and the replacement process will be more fully described below.

As stated above, each end of each shaft 30 is removably attached to one of the support members 20. To accomplish this attachment, in the preferred embodiment each support member 20 has an opening 22 extending through it, which opening 22 is coaxial with its attached shaft 30. The opening 22 receives the end of the shaft 30 attached to the particular support member 20, and the tip 32 of the end of the shaft 30 projects out of the support member 20. Fastening means are also provided for removably attaching the shaft 30 to the support member 20. In the preferred embodiment, the fastening means comprises a lock pin 36, 38 and a hole 34 extending transversely through the projecting tip 32. The lock pin 36, 38 prevents the tip 32 from being pulled back through the opening 22. The lock pin 36, 38 has a straight leg 36 that is received into the hole 34 and a bent leg 38 that engages an outer surface portion of the shaft 30.

Figure 3:
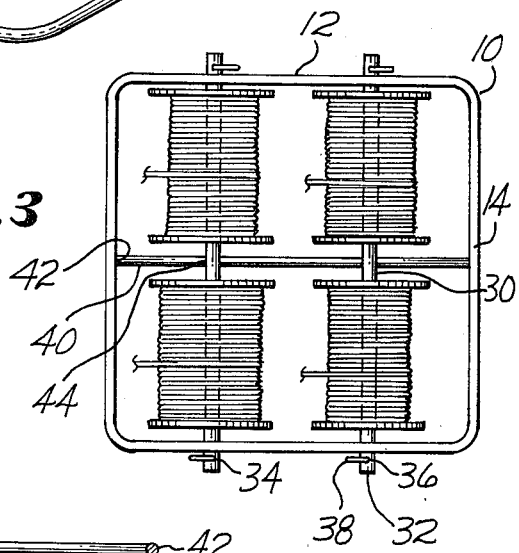
FIG. 3 is a top plan view of the preferred embodiment showing the holder fully loaded with spools.
Figure 2:
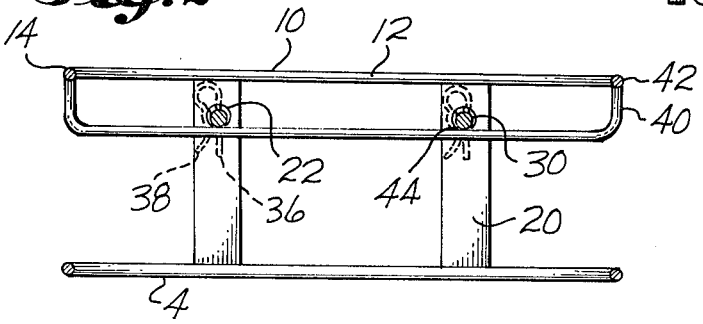
FIG. 2 is a sectional view taken along the line 2—2 of FIG. 1.

The loading process referred to above is carried out as follows. The operator removes the lock pin 36, 38 on one end of a shaft 30 and slides the other end of the shaft 30 outward until the detached end clears the U-shaped shaft support 40 with sufficient room to place the first spool in position for mounting. The operator then holds the shaft 30 with one hand and places the spool in position with the other hand. Using the hand holding the shaft 30, the operator slides the shaft 30 inwardly through the bore of the spool and onto the shaft support 40 until the weight of the shaft 30 and the spool that has been mounted rests on the U-shaped shaft support 40. This frees the hand holding the first spool for grasping and positioning the second spool. The operator holds the second spool in position with the hand so freed and, with the other hand, slides the shaft 30 through the bore of the second spool back into the opening 22 in the support member 20. Finally, the operator replaces the lock pin 36, 38 in the hole 34 in the tip 32 of the shaft 30, and the shaft 30 is then locked into position. This process is repeated in the loading of the second shaft 30. FIG. 3 is a top plan view of the holder 2 showing the positioning of the spools when the holder 2 is fully loaded.

In order to replace any particular spool, the operator removes the lock pin 36, 38 on the tip 32 of the shaft 30 adjacent to the spool. The operator then holds the spool with one hand and, with the other hand, slides the shaft 30 out of the bore of the spool until the spool can be removed from the shaft 30. The end of the shaft 30 which has been detached then rests on the U-shaped shaft support 40, and the operator can remove and put aside the spool to be replaced. The replacement spool is mounted in the same manner that the second spool is mounted in the loading process. Thus, the operator easily replaces a particular spool, and the other spools remain undisturbed in their positions.

The spool holder 2 of this invention can be used in a variety of situations. Since it can be easily carried by one person with one hand, it is particularly useful in situations in which the spools must be moved from one work place to another. In order to carry the holder 2, the operator need only grasp a portion of the upper loop 10 or base 4 and lift the holder 2 into a vertical position.

Once the spool holder 2 is carried to the work place, it is generally placed on the floor with the base 4 contacting the floor. The shafts 30 are so positioned that the spools mounted on them do not come into contact with the upper loop 10 or the floor on which the holder 2 is placed. The sides of the spools extend above the upper loop 10. Thus, wire or the like can be drawn from the spools in either a horizontal or a vertical direction. Additionally, wire or the like can be drawn from all, less than all, or even one spool at a time without disturbing the spools not then in use and without causing overreeling or coasting of such spools.

The open construction of the spool holder 2 enables the operator to readily see when and if more wire is needed on any particular spool. When more wire is required on a particular spool, the operator can replace the spool as described above. Spools of various sizes can be loaded on the spool holder 2 at the same time. This feature, combined with the ready portability of the spool holder 2, makes the spool holder 2 unusually versatile and suitable for a great variety of applications.

Although a preferred embodiment of this invention has been illustrated and described, it is to be understood that various modifications may be made without departing from the spirit and scope of the present invention as defined by the following claims.

I claim:

1. A spool holder comprising:

a base;

an essentially rectangular upper loop positioned above and essentially parallel to the base and having two opposite side members, and two opposite end members which are essentially perpendicular to the side members;

at least two support members, with one such support member connecting the base to an intermediate portion of each side member of the loop;

a cylindrical shaft with two ends, each end being removably attached to one of the support members, and said shaft being offset from and essentially parallel to the end members of the loop; and an upwardly opening, U-shaped shaft support having two ends, one of said ends being attached to an intermediate portion of each of the end members of the loop, and said shaft support being essentially perpendicular to the shaft with an upper portion of said shaft support being contiguous to said shaft.

2. A spool holder as described in claim 1, wherein:

two support members connect the base to each side member of the loop; and two spaced, parallel shafts are removably attached to said support members.

3. A spool holder as described in claim 1, in which the base is the same size and peripheral shape as the upper loop, and corresponding portions of the base and the upper loop are connected by each support member.

4. A spool holder as described in claim 1, wherein:

two support members connect the base to each side member of the loop;

two spaced, parallel shafts are removably attached to said support members; and the base is the same size and peripheral shape as the upper loop, and corresponding portions of the base and the upper loop are connected by each support member.

5. A spool holder as described in claim 1 or claim 4:

wherein each support member has an opening extending therethrough for receiving the end of the shaft attached to said support member, said opening being coaxial with said shaft; and further comprising fastening means for removably attaching said shaft to said support member.

6. A spool holder as recited in claim 5, in which:

each end of said shaft has a tip that projects out of its support member; and the fastening means comprises a hole extending transversely through said tip; and a lock pin having a straight leg that is received into said hole, and a bent leg that engages an outer surface portion of the shaft.

7. A spool holder as recited in claim 4, wherein the upper loop, base, and shaft support are made of solid rods; the shafts are made of rigid hollow tubing; and each support member comprises a flat rectangular bar with a smallest dimension parallel to the end members of the upper loop.

* * * * *